US010317144B2

(12) United States Patent
Glück et al.

(10) Patent No.: US 10,317,144 B2
(45) Date of Patent: Jun. 11, 2019

(54) BRAZED HEAT EXCHANGER

(71) Applicant: Modine Manufacturing Company, Racine, WI (US)

(72) Inventors: Rainer Glück, Tübingen (DE); Klaus Kalbacher, Rangendingen (DE); Michael Daniel, Neuhausen (DE)

(73) Assignee: MODINE MANUFACTURING COMPANY, Racine, WI (US)

( * ) Notice: Subject to any disclaimer, the term of this patent is extended or adjusted under 35 U.S.C. 154(b) by 778 days.

(21) Appl. No.: 14/574,676

(22) Filed: Dec. 18, 2014

(65) Prior Publication Data

US 2015/0241128 A1 Aug. 27, 2015

(30) Foreign Application Priority Data

Feb. 26, 2014 (DE) ..... 10 2014 002 801

(51) Int. Cl.
*F28D 9/00* (2006.01)
*F28D 1/02* (2006.01)
(Continued)

(52) U.S. Cl.
CPC ..... *F28D 9/0043* (2013.01); *F28D 1/0233* (2013.01); *F28D 1/0366* (2013.01);
(Continued)

(58) Field of Classification Search
CPC .... F28F 3/08; F28F 3/083; F28F 3/086; F28F 2280/06; F28F 9/0246; F28F 9/0248;
(Continued)

(56) References Cited

U.S. PATENT DOCUMENTS 4,538,679 A * 9/1985 Hoskins ..... F16L 37/088 165/140
5,875,834 A 3/1999 Brooks
(Continued)

FOREIGN PATENT DOCUMENTS

DE 3826244 2/1990
DE 3913100 10/1990
(Continued)

OTHER PUBLICATIONS

Yoshida, JPH 10-281015, Oct. 20, 1998, machine translation.*
(Continued)

*Primary Examiner* — Hung Q Nguyen
*Assistant Examiner* — Mark L. Greene
(74) *Attorney, Agent, or Firm* — Michael Best & Friedrich LLP; Jeroen Valensa; Michael Bergnach

(57) ABSTRACT

A heat exchanger from a stack of plate pairs having fins which are disposed between the plate pairs, and having ducts which vertically extend through the stack, for conveying in and/or conveying out a medium which flows through the plate pairs and which exchanges heat with another medium which flows through the fins, wherein the ducts are formed from openings in the plates and have moldings which extend around opening peripheries, and having a plate, having corresponding openings, which finishes off the stack, wherein a thermally decoupling element, which is inserted either in an integrated or a separate manner and which is incorporated into the vertical duct formation, is disposed between the finishing-off plate and the stack. Such a heat exchanger displays improved resilience to alternating temperature loadings.

18 Claims, 5 Drawing Sheets

(51) Int. Cl.
*F28D 1/03* (2006.01)
*F28D 21/00* (2006.01)

(52) U.S. Cl.
CPC ..... *F28D 21/0003* (2013.01); *F28F 2225/08* (2013.01); *F28F 2265/26* (2013.01); *F28F 2270/00* (2013.01); *F28F 2275/06* (2013.01); *F28F 2280/06* (2013.01)

(58) Field of Classification Search
CPC .. F28F 2270/00; F28D 9/0062; F28D 9/0068; F28D 1/0366; F28D 9/0031; F28D 9/0043; B21D 53/02; B23P 15/26
See application file for complete search history.

(56) References Cited

U.S. PATENT DOCUMENTS

| | | | | |
|---|---|---|---|---|
| 5,983,992 | A * | 11/1999 | Child | F28D 9/0043 165/153 |
| 6,016,865 | A * | 1/2000 | Blomgren | F28D 9/0043 165/148 |
| 6,530,425 | B2 | 3/2003 | Wehrmann et al. | |
| 7,520,319 | B2 * | 4/2009 | Ohno | F28D 1/0333 165/149 |
| 7,568,520 | B2 * | 8/2009 | Ozawa | F28D 9/0043 138/89 |
| 2002/0104645 | A1 * | 8/2002 | Yoshida | F28D 9/0043 165/166 |
| 2007/0000639 | A1 | 1/2007 | Ozawa et al. | |
| 2008/0041556 | A1 * | 2/2008 | Braun | F02B 29/0462 165/41 |
| 2008/0185136 | A1 * | 8/2008 | Vastine | F02B 29/0462 165/283 |
| 2009/0277165 | A1 * | 11/2009 | Geskes | F02B 29/0418 60/320 |
| 2010/0206516 | A1 | 8/2010 | Muller-Lufft et al. | |
| 2011/0139400 | A1 * | 6/2011 | Hallmann | F28D 9/0012 165/67 |
| 2014/0151006 | A1 * | 6/2014 | Moreau | F28D 1/0333 165/166 |
| 2015/0047818 | A1 | 2/2015 | Peskos et al. | |

FOREIGN PATENT DOCUMENTS

| | | | | |
|---|---|---|---|---|
| DE | 19920786 | 11/2000 | | |
| EP | 2336698 | 6/2011 | | |
| JP | 10281015 A * | 10/1998 | | F28D 9/0075 |
| JP | 2003240477 | 8/2003 | | |
| WO | WO 2012126687 A1 * | 9/2012 | | F28D 1/0333 |

OTHER PUBLICATIONS

Chinese Patent Office Action for Application No. 201510019310.2 dated Dec. 26, 2017 (15 pages, English translation included).
Chinese Patent Office Action for Application No. 201510019310.2 dated Jul. 25, 2018 (16 pages, English translation included).

* cited by examiner

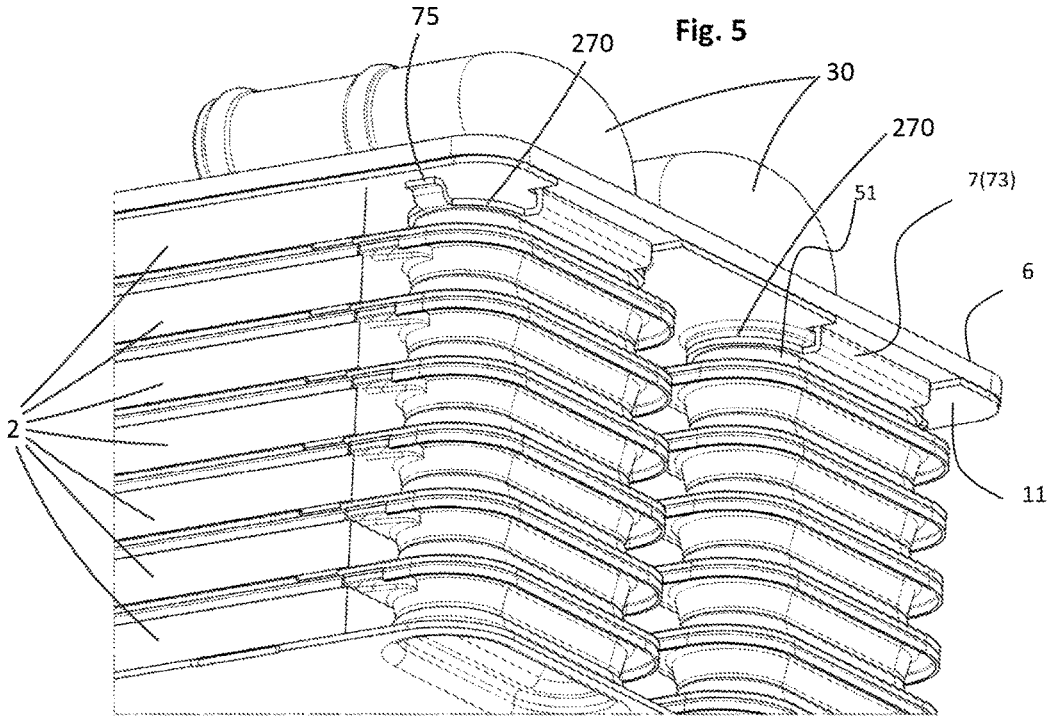
Fig. 5
Fig. 6
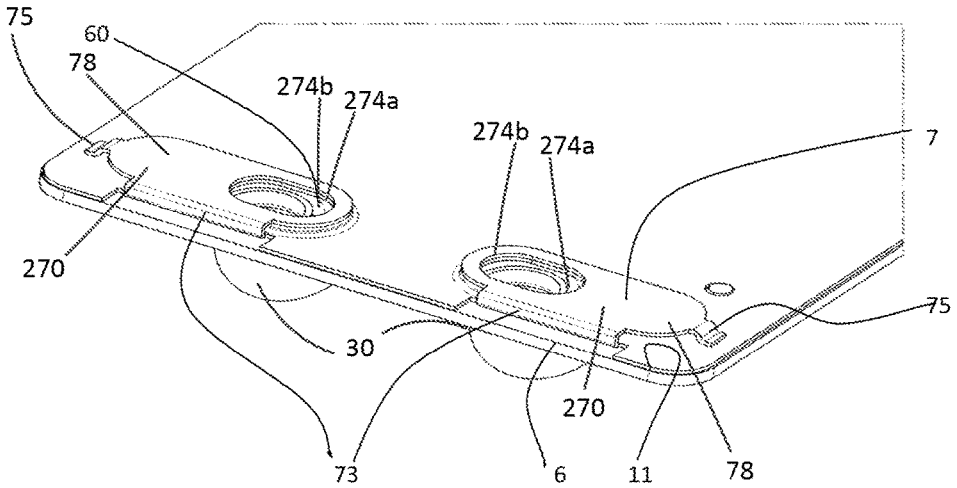

BRAZED HEAT EXCHANGER

CROSS-REFERENCE TO RELATED APPLICATIONS

This application claims priority to German Patent Application No. 10 2014 002801, filed Feb. 26, 2014, the entire contents of which are hereby incorporated by reference herein.

FIELD OF THE INVENTION

The invention relates to a brazed heat exchanger from a stack of plate pairs and fins which are disposed between the plate pairs, and having ducts which vertically extend through the stack, for conveying in and conveying out a medium which flows through the plate pairs and which exchanges heat with another medium which flows through the fins, wherein the ducts are formed from openings in the plates and have moldings which extend around the opening peripheries of said openings, and having a plate, having corresponding apertures, which finishes off the stack.

BACKGROUND

A brazed heat exchanger has been depicted in the older patent application having the file number DE 10 2013 015 179.1, FIGS. 3 and 8. In this heat exchanger, a further but thinner plate has been disposed directly below the finishing-off plate. In this thinner plate, openings having moldings which extend around the opening peripheries of said openings and which, by way of the abovementioned moldings are brazed, as is the entire heat exchanger, to the adjacent first plate of the first plate pair, are likewise located.

In the case of this heat exchanger, deficiencies with regard to the resilience to alternating temperature loadings due to operational reasons have been observed in the course of testing.

SUMMARY

The object of the invention consists in improving the brazed heat exchanger mentioned at the outset with regard to its resilience to alternating temperature loadings due to operational reasons.

It has been determined in the mentioned test that cracks or fractures mainly arise below the finishing-off plate, specifically toward the adjacent moldings.

On account of the provision according to one embodiment of the invention of a thermally decoupling element which is disposed between the finishing-off plate, around the corresponding opening of the latter and toward an adjacent molding, cracks or fractures which are induced by alternating temperature loadings due to operational reasons are eliminated or at least significantly reduced, as has been demonstrated by further testing undertaken in the meantime. The thermally decoupling element may be inserted as an individual part. The thermally decoupling element, however, may also be a specially transformed region of a further plate, that is to say be integrally configured with the mentioned further plate. The further plate is located below the finishing-off plate.

The thermally decoupling element is a flat, plate-like element, the contour of which approximately corresponds to the contour of a molding.

The inventors have established that by means of the thermally decoupling elements(s), variable expansions on account of thermal loadings in the finishing-off plate and in the adjacent plate of the plate pair can be largely compensated for, on account of which the effects described above arise.

The invention will be explained in the following with exemplary embodiments by means of the appended drawings. Further features and advantages of the invention emerge from this description.

BRIEF DESCRIPTION OF THE DRAWINGS

FIGS. 5 and 6 show a third exemplary embodiment.

DETAILED DESCRIPTION

The appended FIGS. 1 to 6 show practical views onto one of two sides, for example narrow sides, of the brazed heat exchanger. Visible are two vertical ducts 3 and 4, wherein these may be ducts 3, 4 for a medium, for example for a coolant, which flows within the plate pairs 10 and/or through the plate pairs 10.

It may be assumed here that the other side, for example narrow side, not shown, is configured in an identical manner. In this case two further vertically extending ducts 3, 4 are located on the other narrow side.

Figure 7:
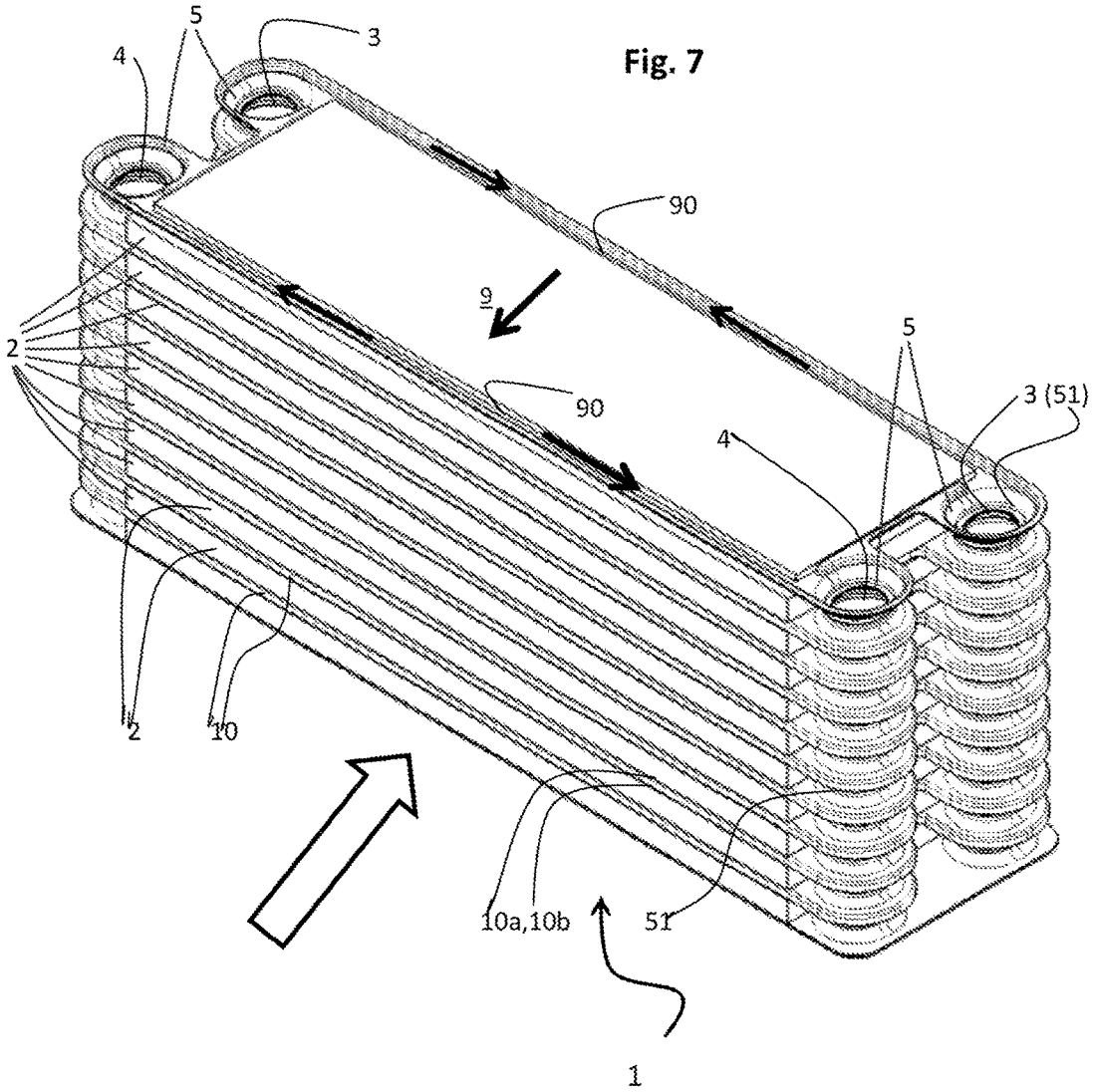
FIG. 7 shows a substantial part of another heat exchanger in which the invention has been implemented.

In order to clarify the aforementioned, FIG. 7 has been added. Otherwise, this figure does not show the matter proposed here, since the region having a cover plate 6 at the top of the stack 1 of plate pairs 10 and fins 2 is not illustrated in FIG. 7. The ducts may be two inflow ducts 3 and two outflow ducts 4. FIG. 7 shows a view into the interior of the uppermost plate pair 10. Ribs 9 are located in the plate pairs 10. The ribs 9 are smaller than the interior of the plate pairs. There are two peripheral ducts 90 which extend in the longitudinal direction of the plates. The one peripheral duct 90 is an inflow-side peripheral duct in which a concurrent flow is present. The other peripheral duct 90 is an outflow-side peripheral duct 90 in which a diverging flow toward the two outflow ducts 4 is present. This design leads to an effective counterflow in relation to another medium, as is to be indicated by the arrows, on account of which the efficiency of heat exchange is improved as a spin-off.

Figure 1:
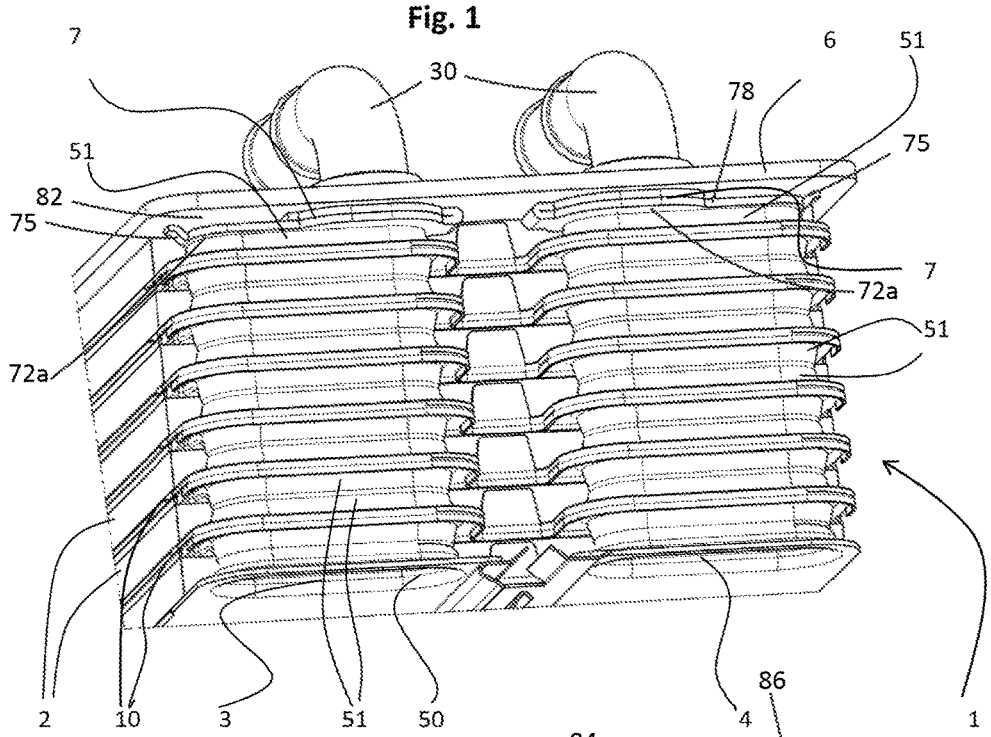
FIG. 1 shows a preferred exemplary embodiment, in a view onto part of a heat exchanger.
Figure 2:
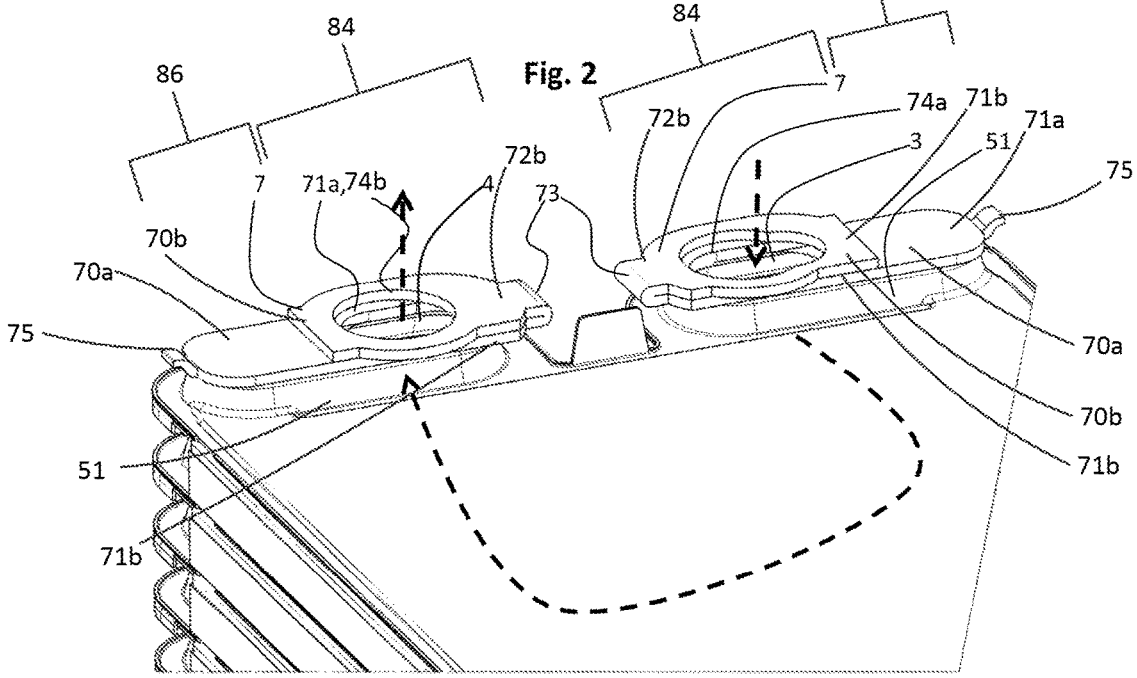
FIG. 2 shows this exemplary embodiment in another view.

However, it may in contrast also be assumed that the two ducts 3 and 4, shown in FIGS. 1 to 6, are the only vertical ducts of the heat exchanger for the mentioned medium, wherein the one duct would be an inflow duct 3 and the other duct would be an outflow duct 4. The arrows in FIG. 2 are intended to indicate this. In the longitudinal direction of the heat exchanger, the medium covers an outward and an inward path. In this case, a throughflow of the heat exchanger would be present in the crossflow.

The ducts 3, 4 are formed from openings 5 in an upper plate 10*a* and in a lower plate 10*b* of the plate pairs 10. The plates 10*a*, 10*b* have moldings 51 which extend around opening peripheries 50 of said openings 5.

Visible are also the already mentioned fins 2 which are disposed between the plate pairs 10. Another medium, which exchanges heat with the first mentioned medium, flows through the fins 2. The other medium may be hot air (or an exhaust emission) which is to be cooled.

The temperature differences for operational reasons between the air and the coolant are enormous and stress the brazed heat exchanger to the point of material fractures which typically lead to the breakdown of the heat exchanger.

In order to improve the resilience of the heat exchanger to such loadings, the measure shown in FIGS. 1 and 2 has proven particularly effective.

As shown by the mentioned figures, this measure is thermally decoupling elements 7 which are separately inserted as an individual part and which are incorporated into the vertical duct formation 3, 4. As can be seen, each duct 3, 4, has been assigned a separate element 7. There thus may be either two or four such elements 7 per heat exchanger. At least one support foot 75 (FIGS. 4 and 6) is disposed on the illustrated thermally decoupling elements 7.

The term "thermally decoupling" used here refers exclusively to thermal influences due to operational reasons on the heat exchanger and/or on its decoupling, not to the brazing-technological production of said heat exchanger, which likewise takes place under thermal influences, as is known. With regard to the brazing-technological production, reference may be made to the prior art, such that no further explanations are required in this respect.

The insertion of the elements 7 takes place between a cover plate 6, which is the uppermost plate lying on top of the stack in the exemplary embodiment, and the upper plate 10*a* of the first plate pair 10. More specifically, the elements 7 are inserted between the cover plate 6 and the moldings 51 which extend around the opening peripheries 50 of the upper plate 10*a* of the first plate pair 10. In respect of their extent, the elements 7 are also only slightly larger than the moldings 51, as shown by FIGS. 1 and 2. A contour of the moldings 51 approximately corresponds to a contour 78 of the element 7, which is to mean that these contours are similar with regard to shape and size. However, the thicknesses vary.

The particular effectiveness of this preferred embodiment may lie in that the elements 7 are provided with at least one fold 73 which, after the production or configuration thereof, leads to a doubling of the thickness of element 7 that extends partially across element 7, the thickness differences across element 7 indicated by a doubling area 84 and an area without doubling 86 in FIG. 2. A second fold (not shown) at the opposite end would lead to a trebling of the thickness. As depicted in FIG. 1, the doubling area 84 of element 7 extends between the cover plate 6 and the upper plate 10*a* of the first plate pair 10, and in the area without the doubling 86, the cover plate 6 is not connected to element 7. The doubling is provided by engagement between sections 70*a* and 70*b* of element 7, section 70*b* being folded onto section 70*a*, such that section 70*b* lies on top of section 70*a* and parallel to section 70*a*. The fold 73 engages a top surface 71*b* of section 70*b* with a top surface 71*a* of section 70*a* such that the top surface 71*a* is partially covered by section 70*b*. A bottom surface 72*a* of section 70*a* then faces away from a bottom surface 72*b* of section 70*b*, the bottom surface 72*b* now facing in the same direction as the top surface 71*a*. Since a portion of the top surface 71*a* is uncovered by section 70*b*, there is a gap 82 between the top surface 71*a* and the cover plate 6, where the cover plate 6 is disengaged from the element 7. It should also be identifiable that the elements 7 are initially punched from a sheet metal having two openings—opening 74*a* of section 70*a* and opening 74*b* of section 70*b*, as shown in FIG. 2. After production of the fold 73 (bending by 180°), the two openings 74*a*, 74*b* lie approximately on top of one another, as shown in FIG. 2. The two openings 74*a* and 74*b* extend the ducts 3, 4 from the upper plate 10*a* of the first plate pair 10 to the cover plate 6, as shown in FIGS. 1 and 2. As can also be seen, the upper opening 74*b* of the elements 7 is slightly larger or designed in a somewhat different manner than the lower opening 74*a*. Said opening 74*a* provides a transition from (in the exemplary embodiment) approximately flat-oval openings 5 and/or approximately flat-oval moldings 51 of the opening peripheries 50 to approximately round apertures 60 in the cover plate 6. Accordingly, round connectors 30 for the coolant are located in the round apertures 60 of the cover plate 6 (FIG. 4).

On account of the elongate or flat-oval openings 5 in the plates 10*a*, 10*b* there is inter alia also an advantageous flexibility in relation to the arrangement of the round connectors 30. The arrangement of the connectors 30 depends on the circumstances of the installation space. This flexibility is not limited by the provision of the elements 7, since the possibility for modifying the design of the elements 7 exists, that is to say for designing said elements 7 so as to be different, as can be seen from FIG. 2.

In other exemplary embodiments (not shown), the elements 7 are all configured so as to be identical, which is definitely more cost effective in relation to their production.

Figure 3:
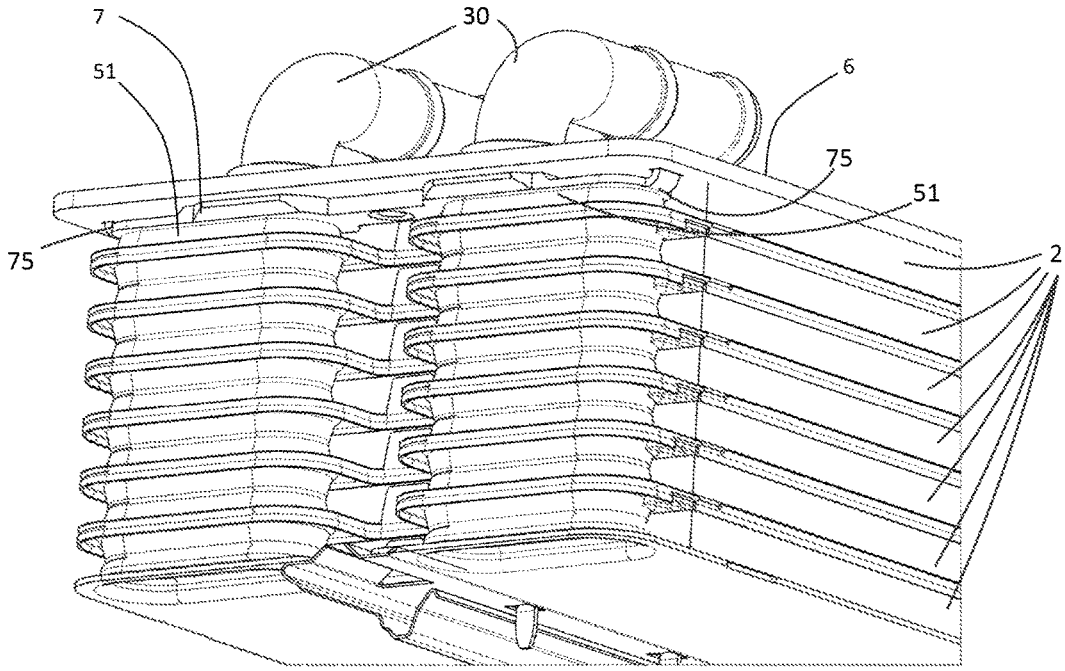
FIGS. 3 and 4 show a second exemplary embodiment.
Figure 4:
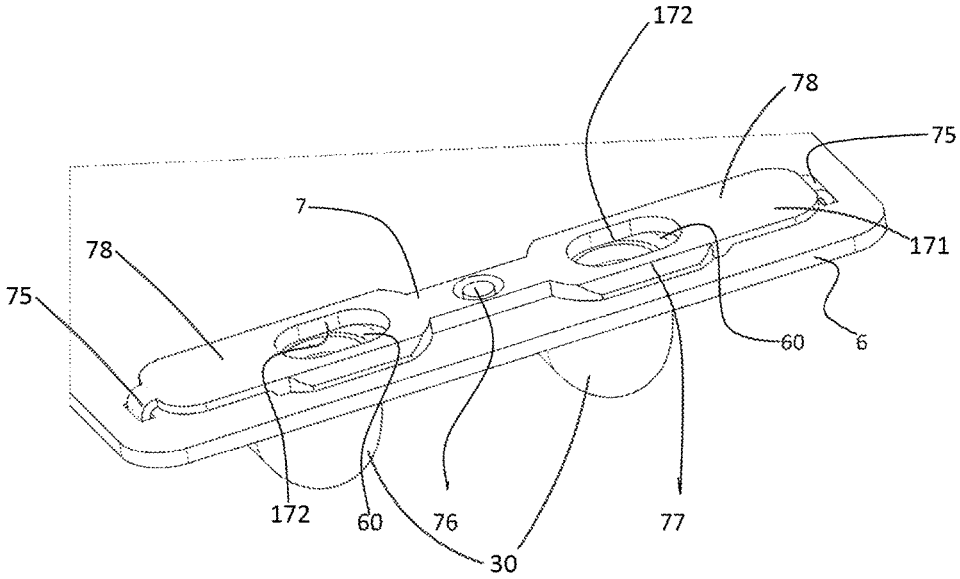

In the exemplary embodiment according to FIGS. 3 and 4, the fold 73 and/or the doubling of the element 7 produced by the fold 73 has been dispensed with. The element 7 has furthermore been configured in one part with two openings 172 for two adjacent ducts 3 and 4. It is also significantly thicker than in the exemplary embodiment according to FIGS. 1 and 2. As can furthermore be seen from FIG. 4, the element 7 has at least in part been provided with a peripheral chamfer 77. The brazing surface can be somewhat enlarged in this manner, but the main objective is presumably to improve the desired positioning of the fin 2, which lies below the cover plate 6, in the course of the pre-assembly of the heat exchanger. A support foot 75 on each end of element 7 is also shown in FIG. 4. Each support foot 75 extends from a bottom surface 171 of element 7 to the cover plate 6. A hole 76 is disposed in the middle of element 7, as depicted in FIG. 4.

In contrast to what has been described above in the exemplary embodiment, according to FIGS. 5 and 6 a further plate 11, which is substantially thinner than the cover plate 6, has been disposed below the cover plate 6. The elements 7, likewise in contrast to what has been mentioned above, have been configured in an integral manner with the thinner further plate 11, that is to say as one piece. In conformance with FIGS. 1 and 2, an element 7 has also here been assigned to each duct 3, 4. A further conformance with the embodiments described above consists in that a doubling is also achieved with these elements 7 by means of a fold 73. On account of the one-piece design, initially the further plate 11, having corresponding projections 270 and the two openings 274*a*, 274*b* from which the elements 7 have to be configured by producing the fold 73, will have to be cut out, wherein the projections 270 are laid inward and wherein the two openings 274*a*, 274*b* are brought into congruence. By means of FIG. 6, this procedure can be particularly clearly traced. The dimension of the further plate 11, with respect to length and width, otherwise corresponds to that of the cover plate 6.

Figure 8:
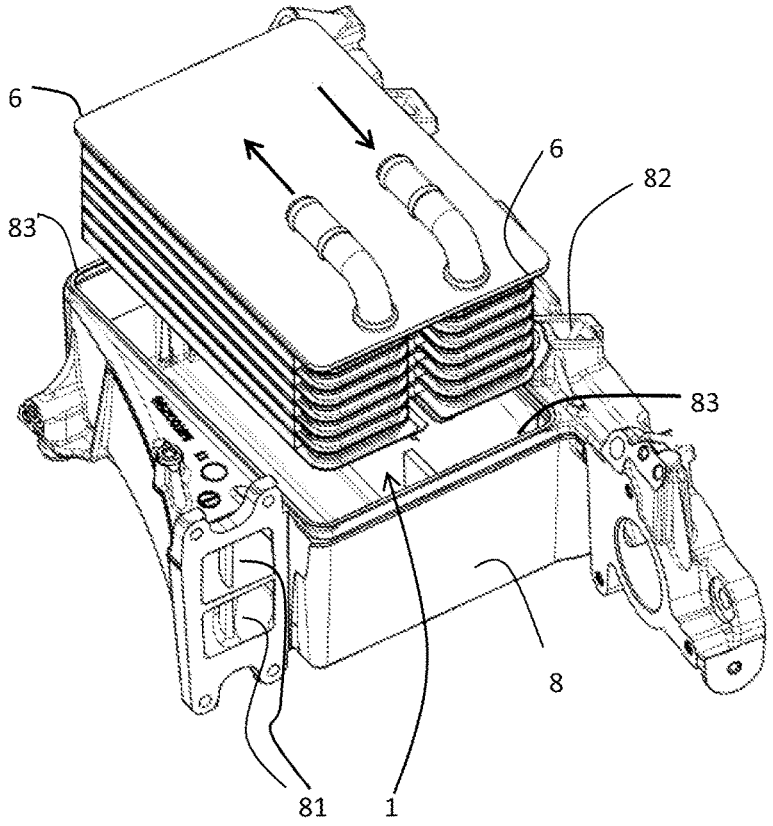
FIG. 8 shows the heat exchanger according to FIG. 1, 3 or 5, inserted into an intake pipe of an internal combustion engine that represents a housing.

FIG. 8 shows that the heat exchanger is disposed in a housing 8, on the one side of which the other medium flows in, flows through the fins 2 of the heat exchanger, and flows out of the housing 8 on the opposite other side of said housing 8, to which end the housing displays corresponding inflow and outflow openings 81, 82.

The heat exchanger is sealed toward the housing 8, in order to suppress bypasses for the other medium.

The medium flowing through the plate pairs 10 and the medium flowing through the fins 2 run either approximately in the direction of counterflow or in the direction of crossflow.

The heat exchanger is inserted into the housing 8 through an insertion opening 83 and, with a projecting, encircling periphery of the cover plate 6, is preferably welded into place on a periphery of the insertion opening 83.

What is claimed is:

1. A brazed heat exchanger comprising:

a stack of plate pairs;

a plurality of fins, at least one fin of the plurality of fins being disposed between two of the plate pairs of the stack of plate pairs;

ducts that vertically extend through the stack of plate pairs, the ducts formed from openings in the plate pairs and moldings that are connected to one another and extend around opening peripheries of the openings, the ducts configured to convey in or convey out a first medium that flows though the plate pairs and that exchanges heat with a second medium that flows through the plurality of fins, each molding of the moldings including a flat surface;

a cover plate having apertures that correspond to the openings in the plate pairs; and a thermally decoupling element including a first surface and a second surface facing an opposite direction from the first surface, the thermally decoupling element disposed between the cover plate and the stack of plate pairs, wherein the thermally decoupling element is incorporated into a formation of at least one of the ducts to provide face to face contact, the first surface contacting the cover plate and the second surface contacting the flat surface of one of the moldings, and a contour of the thermally decoupling element approximately corresponds to an outside contour of the moldings at a location peripheral to the opening peripheries of the openings.

2. The brazed heat exchanger according to claim 1, wherein the thermally decoupling element is disposed around at least one of the apertures of the cover plate and toward an adjacent molding of the moldings.

3. The brazed heat exchanger according to claim 1, wherein the thermally decoupling element includes at least two openings and a bend that is configured in such a manner that, after production of the bend, the at least two openings form a common passage which communicates with a corresponding aperture of the apertures of the cover plate.

4. The brazed heat exchanger according to claim 1, wherein the thermally decoupling element is one of a plurality of separately inserted thermally decoupling elements, each of the apertures in the cover plate having a corresponding one of the plurality of separately inserted thermally decoupling elements.

5. The brazed heat exchanger according to claim 1, wherein the thermally decoupling element is configured in one part and with two openings that are disposed beside one another for two adjacent ducts of the ducts.

6. The brazed heat exchanger according to claim 5, wherein the thermally decoupling element is substantially planar.

7. The brazed heat exchanger according to claim 1, wherein at least one support foot is disposed on the thermally decoupling element.

8. The brazed heat exchanger according to claim 7, wherein positioning aids are disposed on the thermally decoupling element.

9. The brazed heat exchanger according to claim 1, wherein the heat exchanger is disposed in a housing having a first side, a second side opposite the first side, and an end, wherein the second medium flows in the first side, through the plurality of fins, and out from the housing on the second side of the housing.

10. The brazed heat exchanger according to claim 9, wherein the end of the housing includes inflow and outflow openings.

11. The brazed heat exchanger according to claim 9, wherein the heat exchanger is sealed toward the housing in order to suppress bypasses for the second medium.

12. The brazed heat exchanger according to claim 1, wherein the first medium flowing through the plate pairs and the second medium flowing through the plurality of fins lie approximately in the direction of counterflow.

13. The brazed heat exchange according to claim 1, wherein the first medium flowing through the plate pairs and the second medium flowing through the plurality of fins lie approximately in the direction of crossflow.

14. The brazed heat exchanger according to claim 1, wherein the heat exchanger is inserted into a housing through an insertion opening and, with a projecting, encircling periphery of the cover plate welded into place on a periphery of the insertion opening.

15. A brazed heat exchanger comprising:

a stack of plate pairs;

a cover plate disposed at the top of the stack of plate pairs, the cover plate having an aperture;

a duct extending through at least a portion of the stack of plate pairs, the duct being defined by at least one duct opening within the stack of plate pairs and a flat-oval molding disposed around the at least one duct opening;

a plurality of fins located at least partially within the stack of plate pairs and fluidly separated from the duct; and a thermally decoupling element disposed between the cover plate and the stack of plate pairs, the thermally decoupling element including a first part having a first part opening, a second part having a second part opening, and a fold between the first part and the second part, wherein the second part is disposed between the cover plate and the first part, wherein the first part is partially disposed between the flat-oval molding and the second part, wherein the second part directly engages the first part beyond the fold, such that the second part opening lies on top of the first part opening.

16. The brazed heat exchanger according to claim 15, wherein at least one of the plurality of fins is disposed between the cover plate and the stack of plate pairs.

17. The brazed heat exchanger according to claim 15, wherein the first part engages an outer surface of the flat-oval molding and the second part engages the cover plate, and wherein the first part is spaced apart from the cover plate defining a gap between the thermally decoupling element and the cover plate at a portion of the first part peripheral to the second part, such that the portion of the first part is disposed between the gap and the flat-oval molding.

18. The brazed heat exchanger according to claim 17, wherein the aperture is on top of the second part opening and the first part opening is on top of the at least one duct opening.

* * * * *